US009809988B2

(12) United States Patent
Mulhern et al.

(10) Patent No.: US 9,809,988 B2
(45) Date of Patent: Nov. 7, 2017

(54) ANGLED POOL JET FITTING

(71) Applicants: James Mulhern, Nanticoke, PA (US); Stephen Antonishak, Nanticoke, PA (US); Sean Walsh, Westhampton, NY (US)

(72) Inventors: James Mulhern, Nanticoke, PA (US); Stephen Antonishak, Nanticoke, PA (US); Sean Walsh, Westhampton, NY (US)

(73) Assignee: Eco-Blu Pool Components LLC, Forty Fort, PA (US)

( * ) Notice: Subject to any disclaimer, the term of this patent is extended or adjusted under 35 U.S.C. 154(b) by 305 days.

(21) Appl. No.: 14/508,117

(22) Filed: Oct. 7, 2014

(65) Prior Publication Data

US 2015/0176296 A1 Jun. 25, 2015

Related U.S. Application Data

(60) Provisional application No. 61/888,231, filed on Oct. 8, 2013.

(51) Int. Cl.

| | |
|---|---|
| ***A61H 33/04*** | (2006.01) |
| ***E04H 4/12*** | (2006.01) |
| ***E04H 4/16*** | (2006.01) |

(52) U.S. Cl.

CPC ..... *E04H 4/12* (2013.01); *E04H 4/169* (2013.01)

(58) Field of Classification Search

CPC ..... E04H 4/12; E04H 4/169

USPC ..... 4/541.1–541.6

See application file for complete search history.

(56) References Cited

U.S. PATENT DOCUMENTS 8,905,625 B2 * 12/2014 Hartmann ..... B01F 5/0212 366/136

2008/0148500 A1 * 6/2008 Ribeiro ..... E04H 4/169 15/1.7

FOREIGN PATENT DOCUMENTS

EP 1074679 A2 * 2/2001 ..... E04H 4/169

* cited by examiner

*Primary Examiner* — Christine Skubinna

(74) *Attorney, Agent, or Firm* — Baker & Hostetler LLP; Gregory A. Grissett

(57) ABSTRACT

A pool jet fitting can include an insert housing defining an insert body, a housing channel, and a base disposed within the housing channel. The base can include an outer sidewall that defines an internal chamber. The fitting has a valve disposed within the internal chamber. The valve includes a valve body, a valve channel that extends into the valve body along the first direction, and a valve opening that extends through the valve body and into the valve channel along a second direction that is angularly offset with respect to the first direction. The valve is movable between a first position whereby the valve opening has a first area through which the water flow moves and a second position whereby the valve opening has a second area through which the water flow moves that is greater than the first area.

12 Claims, 5 Drawing Sheets

ANGLED POOL JET FITTING

CROSS-REFERENCE TO RELATED APPLICATIONS

This application claims priority to, and the benefit of, U.S. Provisional Patent Application No. 61/888,231 filed Oct. 8, 2013, the entire contents of which are incorporated herein by reference in their entirety.

BACKGROUND

Certain pool jet fittings are configured to direct filtered water downward or downward at an angle. For example, some devices such as the Paramount DownJet, is a fixed orifice/fixed angle eyeball style return nozzle that directs the stream perpendicular from the water inlet pipe, along the pool wall and continuing onto the pool floor, in order to sweep dirt and debris from the pool walls and pool floor. Another type of right angle nozzle is the Paramount SwingJet, which is a fixed orifice/variable angle down jet that automatically rotates during cycling. Another type of down jet is the Venturi return from Infusion Pool products, also a fixed orifice/fixed angle nozzle.

With the advent of energy saving two-speed and variable speed pool pumps that save energy by running at lower speeds, there exists a need to optimize flow patterns for best performance and pump efficiency, saving energy and therefore saving money for the pool owner. Pool pumps typically are operated several hours of the day at high speeds, and consume a large amount of energy. The energy consumption involved during such usage can account for a major portion of a home owner's energy costs. To address this problem, variable speed water pumps have been introduced that can operate at low speeds. When operating at low speeds, however, the pool jet fittings do not perform their functions adequately. The aforementioned devices, with the exception of the Paramount SwingJet, being of the fixed orifice design lack the capability to tune the orifice size for optimal flow and pump efficiency. The SwingJet does have provisions to accept different sized fixed orifices, but changing size during setup is difficult, and would never be considered by the pool owner to accommodate the various pump speeds necessary to facilitate all situations.

One drawback of any multi-part device in these applications, such as the Paramount SwingJet, is the possibility of sticking or jamming due to debris and/or abrasives getting into the mechanisms.

SUMMARY

In accordance with an embodiment, a pool jet fitting can include an insert housing defining an insert body and a housing channel that extends through the insert body along a first direction. The fitting can further include a base disposed within the housing channel. The base can include an outer sidewall that defines an internal chamber. The base defines a base opening that is configured to receive a fluid flow along the first direction. The fitting can further include a valve disposed within the internal chamber. The valve can include a valve body, a valve channel that extends into the valve body along the first direction and is configured to receive the fluid flow, and a valve opening that extends through the valve body and into the valve channel along a second direction that is angularly offset with respect to the first direction so as to redirect the fluid flow from the first direction to the second direction. The valve is movable along the first direction between a first position whereby the valve opening has a first area through which the water flow moves and a second position whereby the valve opening has a second area through which the water flow moves that is greater than the first area.

BRIEF DESCRIPTION OF THE DRAWINGS

The foregoing summary, as well as the following detailed description of an example embodiment of the application, will be better understood when read in conjunction with the appended drawings, in which there is shown in the drawings example embodiments for the purposes of illustration. It should be understood, however, that the application is not limited to the precise arrangements and systems shown. In the drawings.

DETAILED DESCRIPTION OF ILLUSTRATIVE EMBODIMENTS

Figure 1:
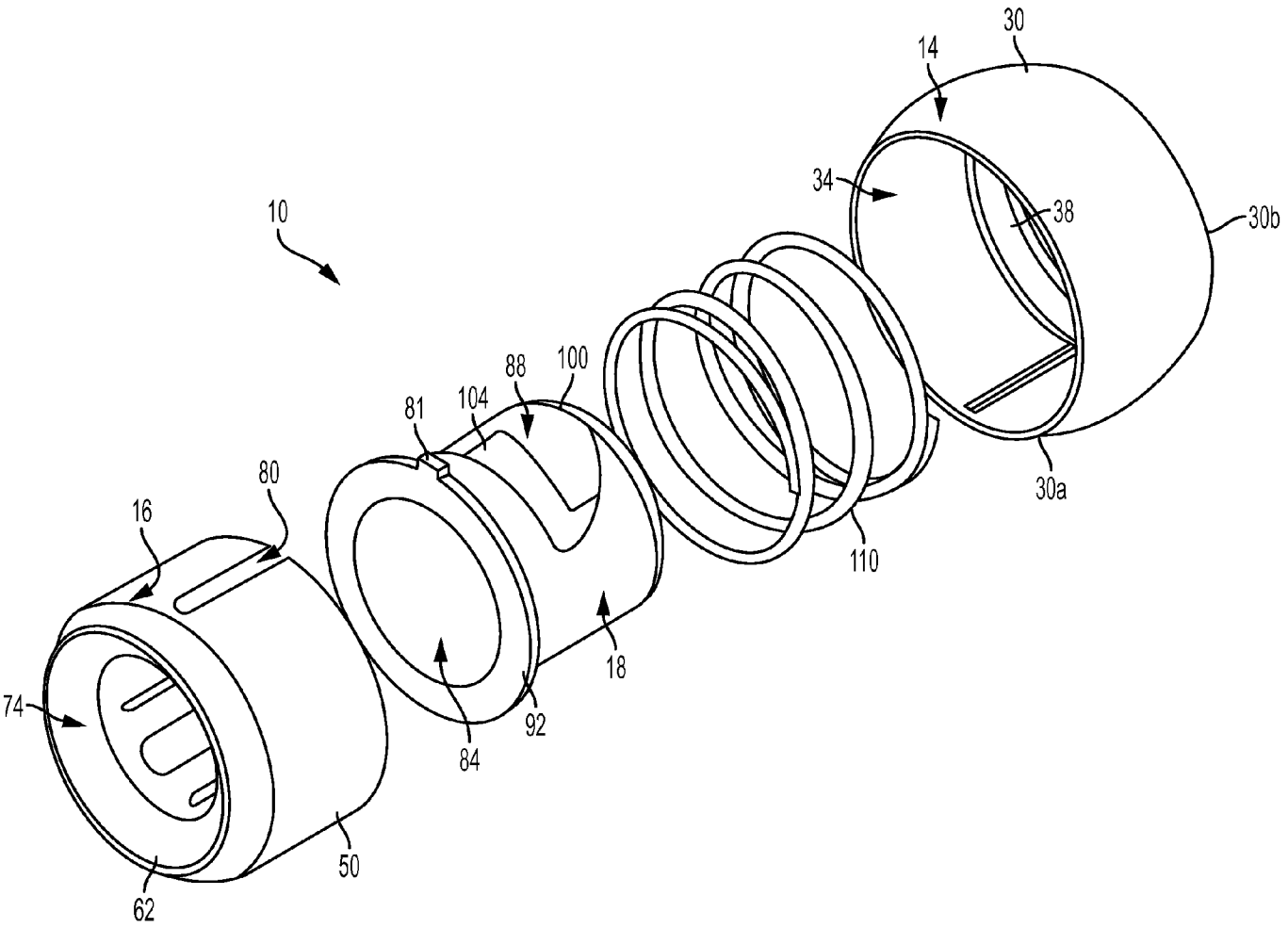
FIG. 1 is a rear exploded view of a pool jet fitting in accordance with an embodiment, the pool jet fitting having an insert housing, a base positioned within the insert housing, a valve movably positioned within the base between a first position and a second position, and a spring configured bias the valve toward the first position.

Certain terminology is used in the following description for convenience only and is not limiting. The words "right", "left", "lower" and "upper" designate directions in the drawings to which reference is made. The words "proximally" and "distally" refer to directions toward and away from, respectively, certain components of the pool jet fitting. The terminology includes the above-listed words, derivatives thereof and words of similar import.

Figure 2:
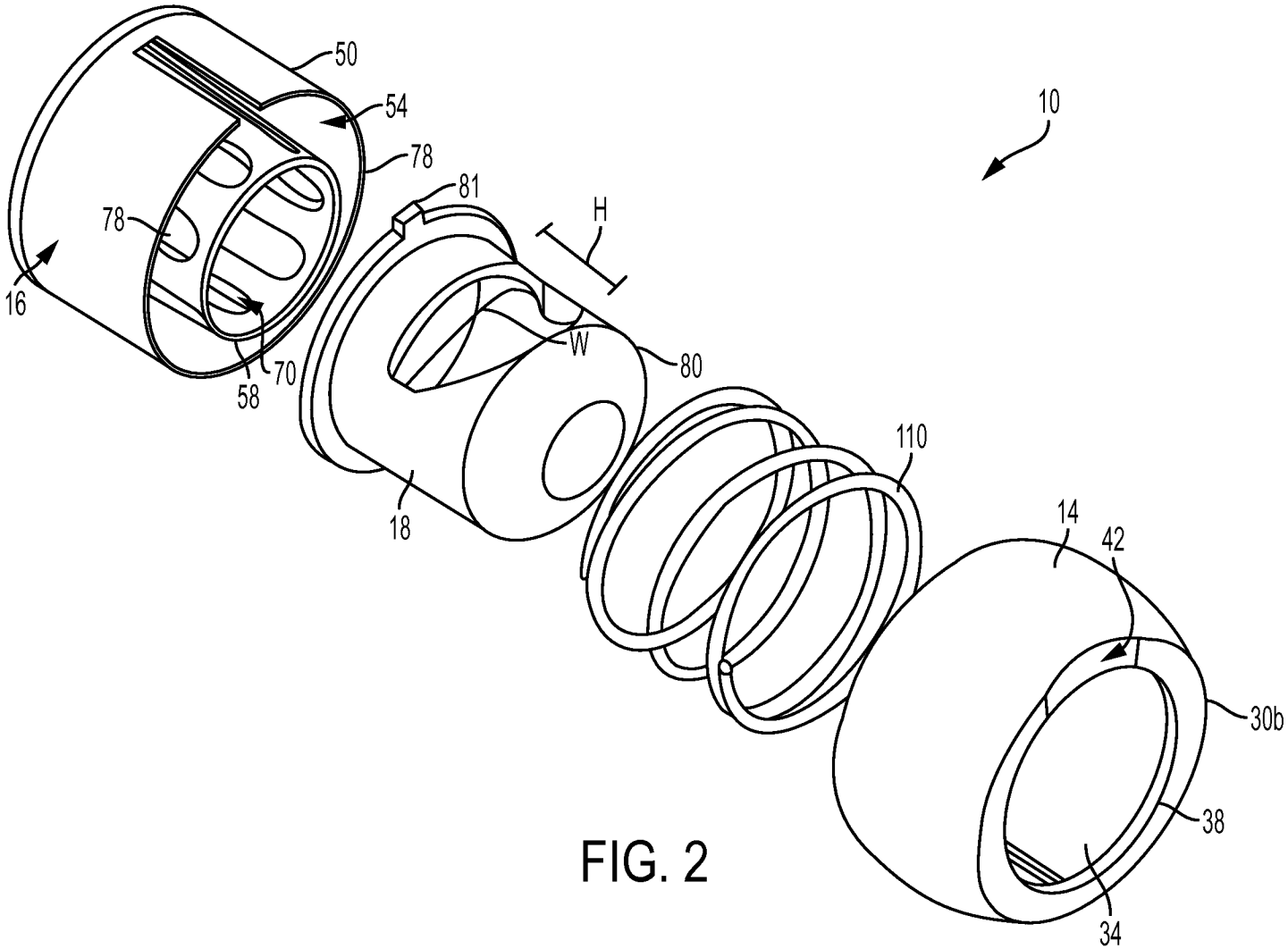
FIG. 2 is a front exploded view of the pool jet fitting shown in FIG. 1, the base including a support that is received by the valve, the support defining a plurality of slots'

Referring to FIGS. 1 and 2 a pool jet fitting 10 can include an insert housing 14, a base 16 disposed within the insert housing 14, and a valve 18 movable within the base 16 along a first direction between a first position and a second position. The insert housing 14 can be sized and configured to be placed within a fitting housing that is configured to be coupled to a wall mount of a pool. The fitting housing defines a bore that is configured to receive a water flow from a water pump. It should be appreciated, however, that the pool jet fitting can be sized and configured to be coupled to a wall, floor or other structure of a pool. It should further be appreciated, that the term pool encompasses, swimming pools, hot tubs, and other structures configured to retain water that requires filtering.

The pool jet fitting 10 defines a water flow exit 22 (see FIG. 3) through which the water flow moves. The exit 22 is configured to redirect the water flow from the first direction to a second direction that is angularly offset with respect to the first direction. In the illustrated embodiment, the second direction is perpendicular to the first direction. The water flow exit 22 is a variable orifice that automatically varies in size according to the incoming water flow and pressure. The size and shape of the opening is shaped to optimize flow patterns and debris sweep performance.

With continued reference to FIGS. 1 and 2, the insert housing 14 includes an insert body 30 and a channel 34 that extends through the insert body 30 along the first direction. The insert body 30 can define a proximal end 30*a* and a distal end 30*b* that is spaced from the proximal end 30*a* along the first direction. As shown in FIG. 2, the insert housing 14 further includes a distal wall 38 or flange that extends radially inward from the insert body 30 and into the channel 34. The distal end 30*b* of the insert body 30 defines a recessed portion 42 that is concave and configured to align with an opening of the valve 18 such that the opening of the valve 18 and the recessed portion 42 together define the water flow exit 22 of the pool jet fitting 10.

Figure 3:
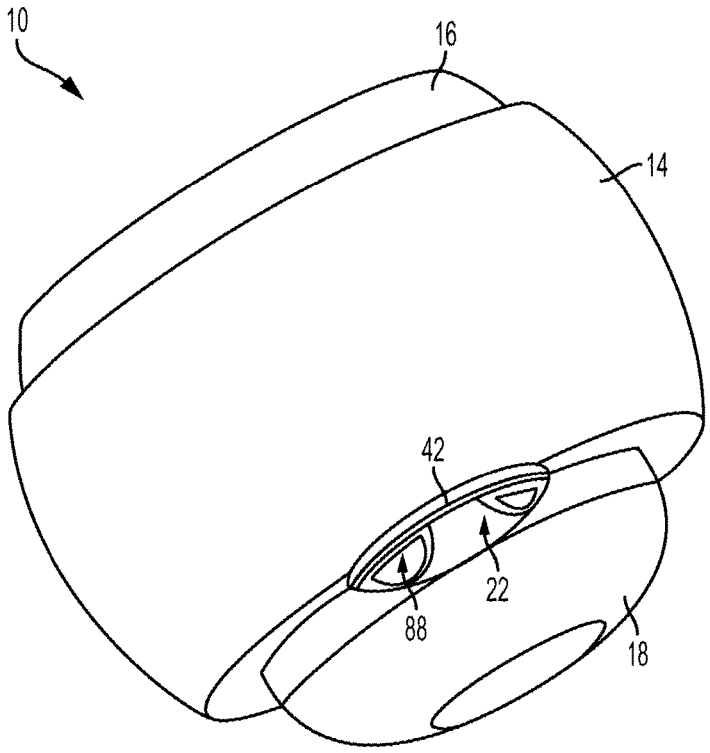
FIG. 3 is a bottom perspective view of the pool jet fitting shown in FIG. 1, the valve having an opening that is aligned with a recess of the insert housing.

As shown in FIG. 2, the base 16 is disposed within the housing channel 34. As shown, the base 16 includes an outer sidewall 50 that defines an internal chamber 54, and an inner sidewall 58 that extends into the internal chamber 54 and a proximal wall 62 that joins the inner sidewall 58 to the outer sidewall 50. As shown in FIG. 3, the valve 18 is movably disposed between the inner sidewall 58 and the outer sidewall 50. And the proximal wall 62 and distal wall 38 of the insert housing 14 are configured to trap the valve 18 to thereby limit movement of the valve 18 along the first direction.

With continued reference to FIG. 2, the inner sidewall 58 defines a base channel 70 that extends along the first direction and is configured to receive the water flow from a base opening 74. The inner sidewall 58 further defines at least one slot 78 that extends therethrough and into the base channel 70. In particular, the inner sidewall defines a plurality of slots 78 that extend therethrough and into the base channel 70. As shown, the slots 78 are radially spaced from each other and are elongate along the first direction. The slots 78 are configured to allow for a flushing action to clear any debris that may impede movement of the valve 18.

With continued reference to FIGS. 1 and 2, the outer sidewall 50 defines a tab receiving slot 80 that is elongate along the first direction. The tab receiving slot 80 is configured to receive a tab 81 of the valve 18 to thereby prevent rotation of the valve 18 as the valve 18 moves between the first and second positions. The tab receiving slot 80 can be open at its distal end as illustrated, though it should be appreciated, that the tab receiving slot 80 can be enclosed as desired.

With continued reference to FIG. 2, the valve 18 is disposed within the internal chamber 54 of the base 16 between the inner and outer sidewalls 58 and 50. The valve 18 includes a valve body 83, a valve channel 84 that extends into the valve body 83 along the first direction, and a valve opening 88 that extends through the valve body 83 and into the valve channel 84 along the second direction that is angularly offset with respect to the first direction so as to redirect the fluid flow from the first direction to the second direction. The valve 18 further includes a proximal flange 92 that extends radially out from the valve body 83. The proximal flange 92 is trapped between the proximal wall of base 16 and the distal wall of the insert housing 14 such that the valve 18 is movable along the first direction between the first position whereby the valve opening 88 has a first area through which the water flow moves and a second position whereby the valve opening 88 has a second area through which the water flow moves that is greater than the first area.

Now in reference to FIGS. 2 and 3, the valve opening 88 has a convex distal end 100 and a flat proximal end 104. The valve opening 88 can have a maximum height H and a maximum width W. The height H and the width W can have dimensions that promote optimal debris sweep patterns. That is the opening 88 can be shaped so as to have ideal height H to width W ratios through the whole range of opening sizes that promote optimal debris sweep patterns.

Referring back to FIGS. 1 and 2, the pool jet fitting 10 can further include a biasing member 110 that is configured to bias the valve 18 toward the first position. In the illustrated embodiment, the biasing member 110 is a spring. It should be appreciated, however, that the biasing member 110 can have any configuration as desired. As shown in FIG. 1, the spring 110 can be trapped between the proximal flange of the valve 18 and the distal wall of the insert housing 14.

Figure 4B:
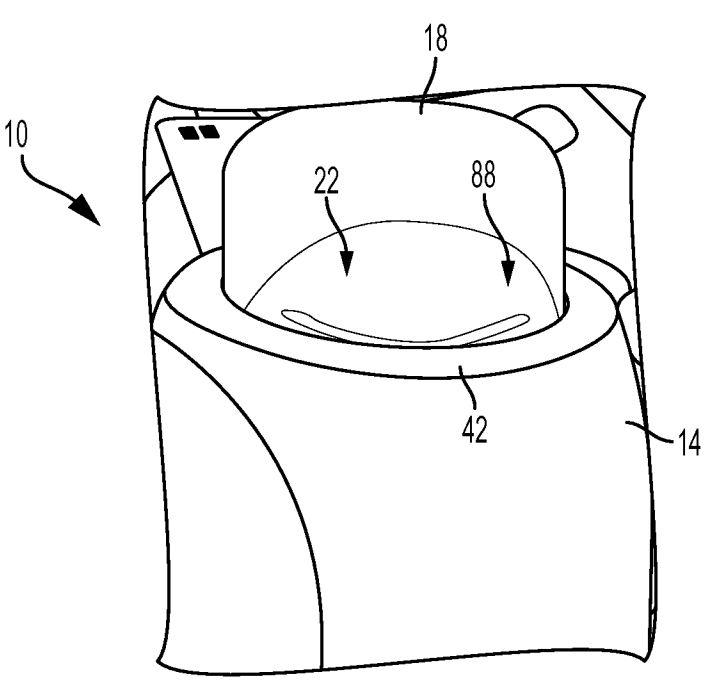
FIG. 4B is a bottom perspective view of the pool jet fitting shown in FIG. 2 in a second position.
Figure 4A:
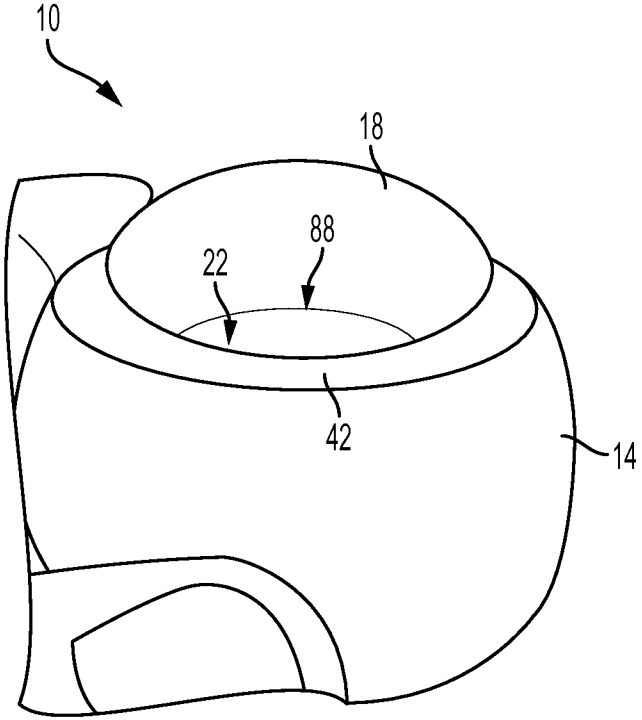
FIG. 4A is a bottom perspective view of the pool jet fitting shown in FIG. 1 in the first position.
Figure 4C:
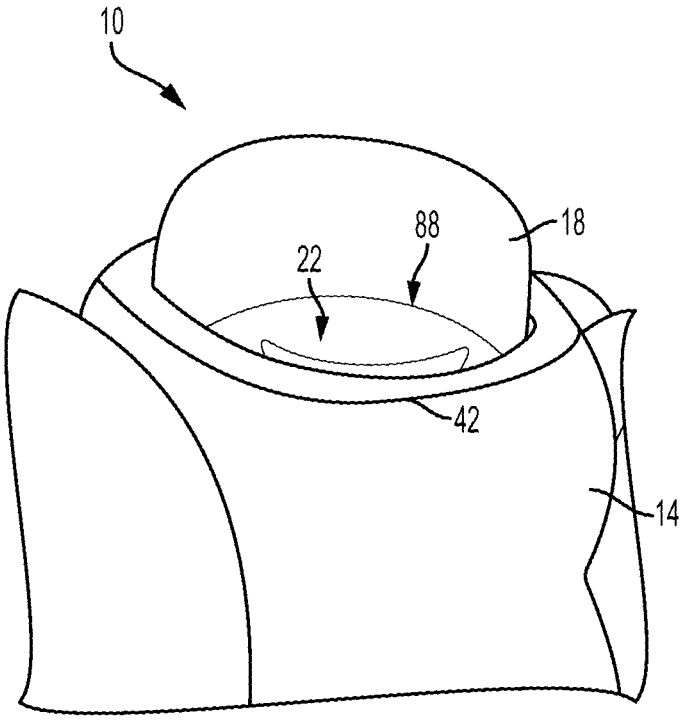
FIG. 4C is a bottom perspective view of the pool jet fitting shown in FIG. 1 in a position that is between the first and second positions.

Now referring to FIGS. 4A-4C, the valve opening 88 and thus the water flow exit 22 defines a variable sized orifice. As shown in FIG. 4A, the valve opening 88 defines a first area through which the water flow moves when the valve 18 is in the first position. As the water pressure increases the valve is moved distally. And as the valve 18 moves distally, the valve opening 88 increases, thereby increasing the area through which the water flow moves or otherwise exits the valve opening 88. FIG. 4B shows the valve in the second position and 4C shows the valve 18 in a position that is between the first and second positions. By having a variable opening 88, the velocity of the water flow through the water flow exit 22 will be maintained at or above a predetermined acceptable minimum velocity. Therefore, debris on the walls or floor of the pool can be moved toward the filter regardless of what speed the water pump is operating.

While the foregoing description and drawings represent the preferred embodiment of the present invention, it will be understood that various additions, modifications, combinations and/or substitutions may be made therein without departing from the spirit and scope of the invention as defined in the accompanying claims. In particular, it will be clear to those skilled in the art that the invention may be embodied in other specific forms, structures, arrangements, proportions, and with other elements, materials, and components, without departing from the spirit or essential characteristics thereof. One skilled in the art will appreciate that the invention may be used with many modifications of structure, arrangement, proportions, materials, and components, which are particularly adapted to specific environments and operative requirements without departing from the principles of the invention. In addition, features described herein may be used singularly or in combination with other features. For example, features described in connection with one component may be used and/or interchanged with features described in another component. The presently disclosed embodiment is therefore to be considered in all respects as illustrative and not restrictive, the scope of the invention being indicated by the appended claims, and not limited to the foregoing description.

It will be appreciated by those skilled in the art that various modifications and alterations of the invention can be made without departing from the broad scope of the appended claims. Some of these have been discussed above and others will be apparent to those skilled in the art.

What is claimed:

1. A pool jet fitting comprising:

an insert housing defining an insert body and a housing channel that extends through the insert body along a first direction;

a base disposed within the housing channel, the base including an outer sidewall that defines an internal chamber, and an inner sidewall that extends into the internal chamber, the base defining a base opening that is configured to receive a fluid flow along the first direction; and a valve disposed within the internal chamber and further being movably disposed between the inner and outer sidewalls, the valve including a valve body, a valve channel that extends into the valve body along the first direction and is configured to receive the fluid flow, and a valve opening that extends through the valve body and into the valve channel along a second direction that is angularly offset with respect to the first direction so as to redirect the fluid flow from the first direction to the second direction, the valve being movable along the first direction between a first position whereby the valve opening has a first area through which the water flow moves and a second position whereby the valve opening has a second area through which the water flow moves that is greater than the first area.

2. The pool jet fitting of claim 1, wherein the inner sidewall defines at least one slot that extends therethrough.

3. The pool jet fitting of claim 2, wherein the inner sidewall defines a plurality of slots that extend therethrough.

4. The pool jet fitting of claim 3, wherein each slot is elongate along the first direction.

5. The pool jet fitting of claim 3, wherein the inner sidewall defines a base channel that extends along the first direction and is configured to receive the water flow from the base opening.

6. The pool jet fitting of claim 1, wherein the outer sidewall defines a tab receiving slot that is elongate along the first direction, and wherein the valve defines a tab that is received within the tab receiving slot to thereby prevent rotation of the valve as the valve moves between the first and second positions.

7. The pool jet fitting of claim 1, wherein the base includes a proximal wall that joins the inner sidewall to the outer sidewall, the valve further includes a proximal flange that extends radially out from the valve body, and the insert housing defines a distal wall such that the proximal wall of the base and distal wall of the insert housing trap the proximal flange of the valve to thereby limit movement of the valve along the first direction.

8. The pool jet fitting of claim 1, wherein the valve opening has a distal end that is convex.

9. The pool jet fitting of claim 8, wherein the valve opening has a proximal end that is flat.

10. The pool jet fitting of claim 8, wherein a distal end of the insert housing defines a recessed portion that is aligned with the valve opening such that the recessed portion and the valve opening together define a water flow exit of the pool jet fitting.

11. The pool jet fitting of claim 1, further comprising a biasing member configured to bias the valve toward the first position.

12. The pool jet fitting of claim 11, wherein the biasing member is a spring.

* * * * *